US005588953A

United States Patent [19]

Chang

[11] Patent Number: 5,588,953

[45] Date of Patent: Dec. 31, 1996

[54] ROLLER ASSEMBLY FOR MASSAGING DEVICE

[76] Inventor: Chien-Chung Chang, No.82,Ho Tso Street, Sun Chung Li, Feng Yuan City, Taiwan

[21] Appl. No.: 580,310

[22] Filed: Dec. 28, 1995

[51] Int. Cl.[6] ..... A61H 15/00; A61H 39/04

[52] U.S. Cl. ..... 601/124; 601/120; 601/122; 601/132; 601/134

[58] Field of Search ..... 601/112, 113, 601/115, 116, 117, 118, 119, 120, 121, 122, 123, 124, 125, 126, 127, 128, 129, 130, 131, 132, 133, 134, 135, 143

[56] References Cited

U.S. PATENT DOCUMENTS

| | | | |
|---|---|---|---|
| 444,597 | 1/1891 | Lichtenstadt | 601/119 X |
| 662,083 | 11/1900 | McFadden | 601/132 X |
| 681,331 | 8/1901 | Milkman | 601/132 X |
| 718,594 | 1/1903 | Bailey | 601/120 |
| 863,144 | 8/1907 | Bowser | 601/132 |
| 1,513,475 | 10/1924 | Bell | 601/123 |
| 1,516,344 | 11/1924 | Knowles | 601/132 |
| 1,630,149 | 4/1925 | Wahrt | 601/119 |
| 1,849,629 | 4/1929 | Lewis | 601/132 |
| 2,227,724 | 1/1940 | Kosa, Sr. | 601/132 |
| 2,549,933 | 4/1951 | Rohlffs | 601/124 X |
| 2,578,916 | 12/1951 | Belleville | 601/125 |
| 4,008,715 | 2/1977 | Brodbeck | 601/128 |
| 4,191,179 | 3/1980 | Mattila | 601/132 |
| 4,531,513 | 7/1985 | Liming | 601/122 |
| 4,622,956 | 11/1986 | Nesheim | 601/119 |
| 4,870,955 | 10/1989 | Adamek-Hetzel | 601/132 |

FOREIGN PATENT DOCUMENTS

| | | | |
|---|---|---|---|
| 406039010 | 2/1994 | Japan | 601/118 |
| 17750 | 11/1895 | United Kingdom | 601/124 |

*Primary Examiner*—Sam Rimell
*Assistant Examiner*—Robert V. Racunas
*Attorney, Agent, or Firm*—Bacon & Thomas

[57] ABSTRACT

A roller assembly for a massaging device is composed of a shaft, a plurality of roller sleeves, and a locating plug. The shaft is provided in the hollow end thereof with a plurality of retaining ribs and is further provided at another end thereof with two lugs and a ratchet located between two lugs for holding a resilient cord. The roller sleeves are fitted rotatably over the shaft and are provided respectively on the outer wall surface thereof with a plurality of massaging protuberances. The locating plug is provided in the outer wall surface of one end thereof with a plurality of retaining slots engageable securely with the retaining ribs of the shaft. The locating plug is further provided at another end thereof with two lugs and a ratchet located between the two lugs for holding securely a resilient cord. The locating plug is secured at one end thereof to the hollow end of the shaft for locating the roller sleeves which are fitted over the shaft.

2 Claims, 3 Drawing Sheets

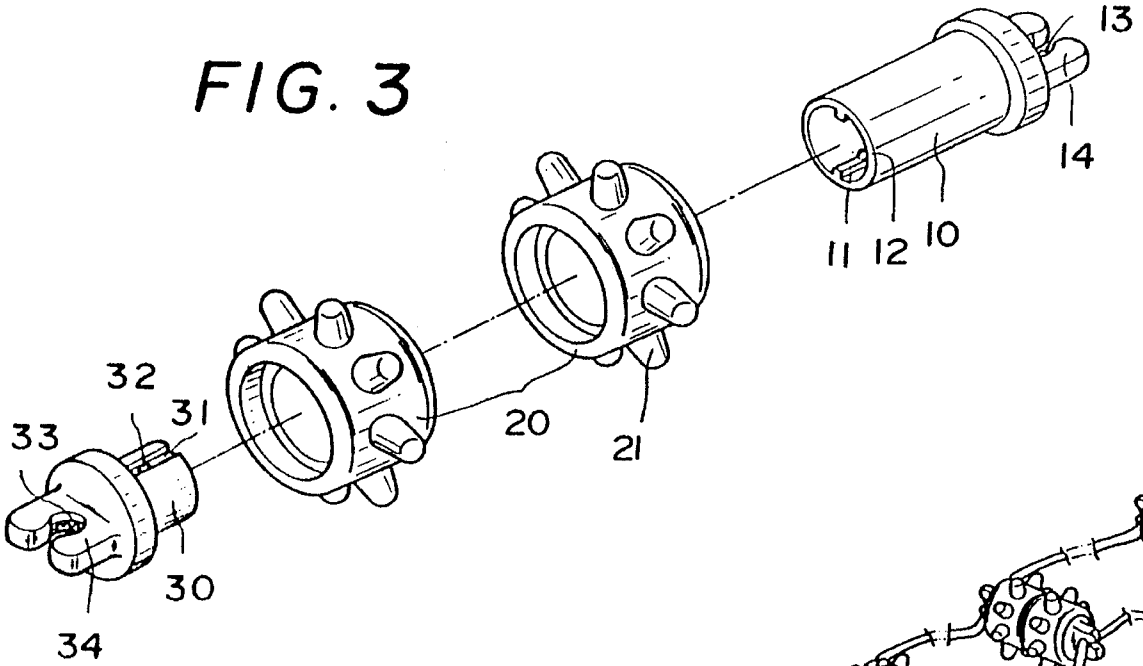
FIG. 3
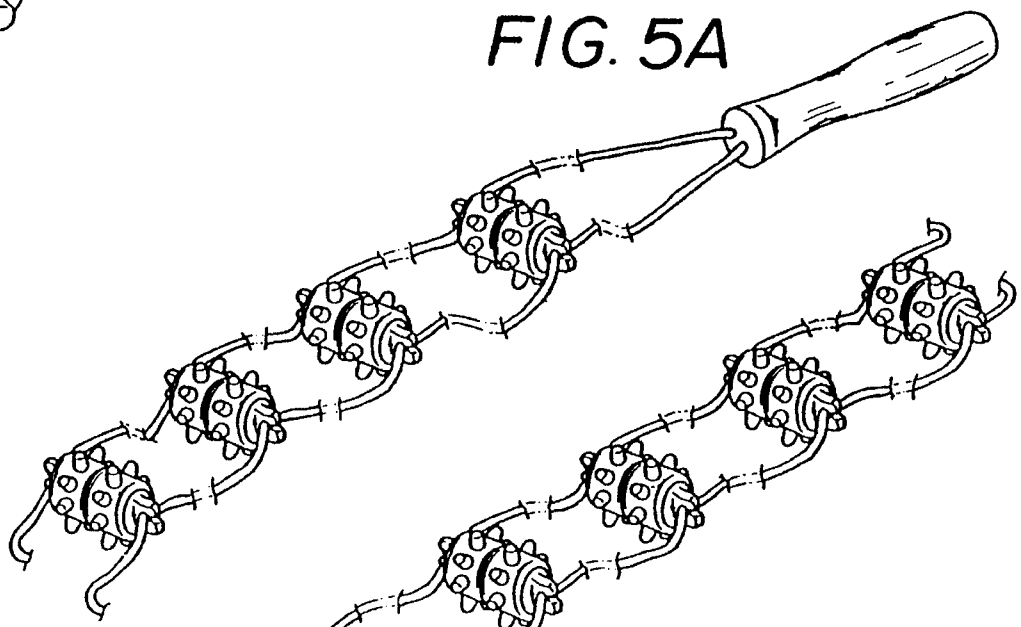
FIG. 5A
FIG. 5B

FIG. 4A
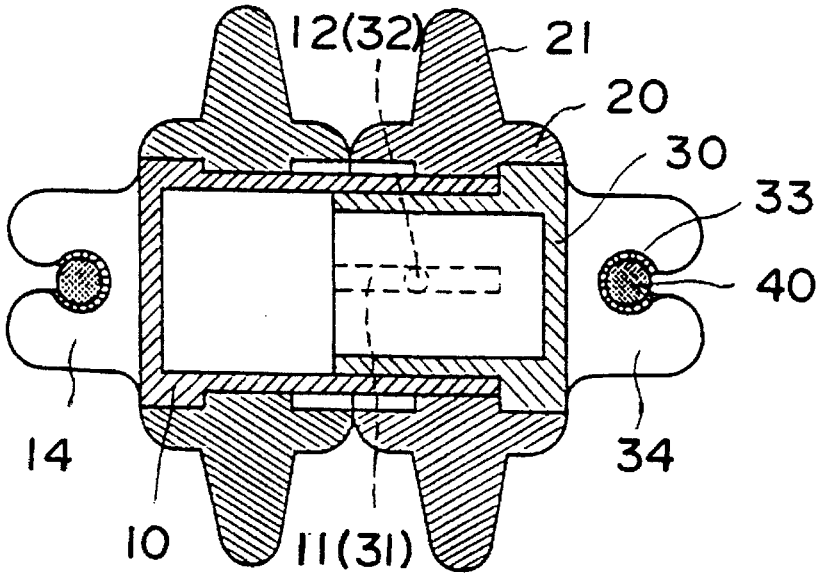
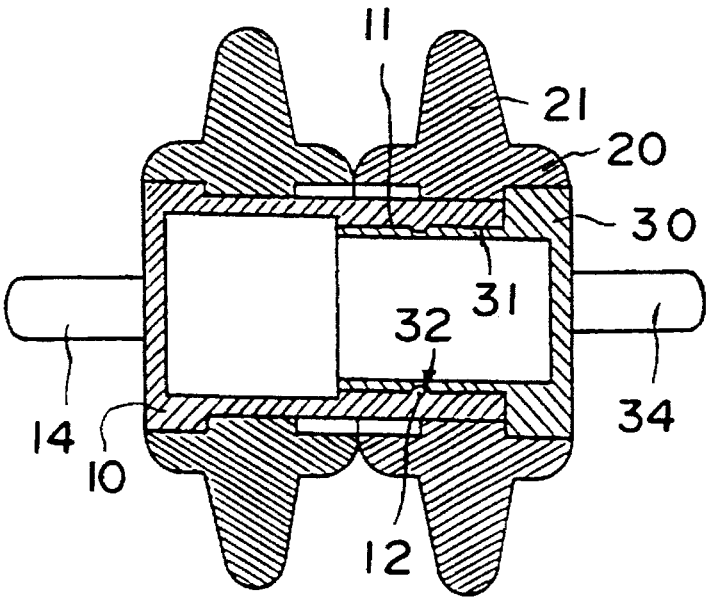
FIG. 4B

ROLLER ASSEMBLY FOR MASSAGING DEVICE

FIELD OF THE INVENTION

The present invention relates generally to a massaging device, and more particularly to a roller assembly intended for use in the massaging device.

BACKGROUND OF THE INVENTION

A human body is composed of numerous points where the nerve centers are located. Accordingly, the act of rubbing, kneading, etc. of the human body can stimulate the circulation and make the muscles supple. In addition, the act of massage can help relieve tension. In an industrialized nation, people are prone to suffer from fatigue and tension, which are often brought about by the pressure at the working place. It is often difficult for the busy people to find time or an appropriate place to engage in an activity capable of body relaxation and relief of tension. As a result, a variety of exercise devices and massaging devices are made available to the consumers at large. These exercise and massaging devices are not necessarily suitable for use in relaxing the body and relieving tension. The case in point is the back massaging device, which is generally composed of a plurality of rollers, hollow sleeves, center shafts, and two cords. As shown in FIG. 1, the rollers are mounted on the center shafts which are fastened respectively at both ends thereof with two cords. Such a back massaging device of the prior art as described above has inherent shortcomings, which are described hereinafter.

The rollers of the prior art massaging device are made of a wooden material and are provided respectively with an arcuate surface for enhancing the massaging effect. In the first place, the wooden rollers are rather expensive. The additional work done for providing each of the wooden rollers with an arcuate surface will no doubt result in an increase in the cost of making the massaging device. In addition, the rollers and the center shafts are located by means of the sleeves which incur additional expenses.

The production efficiency of the prior art back massaging device is poor in view of the fact that the assembly of rollers, center shafts, sleeves and cords is labor-intensive and can not be done easily and rapidly. In other words, a mass production of the prior art massaging device can not be attained in a short period of time.

The back massaging device of the prior art is not provided with an excellent massaging effect in view of the fact that the arcuate surfaces of the rollers of the massaging device are incapable of stimulating the points where the nerve centers of the back are located.

The replacement of a damaged or cracked roller of the prior art massaging device can not be done easily. To replace just one roller, it is necessary to dismantle the entire massaging device. Since the damaged or cracked roller can inflict a skin injury on the back of a user of the massaging device, it is imperative that the massaging device having damaged or cracked rollers should not be used.

SUMMARY OF THE INVENTION

It is therefore the primary objective of the present invention to provide a massaging device with a roller assembly which can be disassembled and reassembled easily and rapidly.

The foregoing objective of the present invention is attained by a roller assembly, which comprises a horizontal shaft, a plurality of roller sleeves, and a locating plug. The roller sleeves are rotatably fitted over the horizontal shaft. Each of the roller sleeves is provided on the outer surface thereof with a plurality of protuberances attached securely thereto. The horizontal shaft has one end which is of a hollow construction and is provided on the inner wall thereof with two retaining ribs opposite in location to each other and engageable respectively with two retaining slots located in the outer wall surface of one end of the locating plug. The retaining ribs are provided respectively with a projection engageable securely with a recess located in the retaining slot of the locating plug. The horizontal shaft has another end provided with two lugs and a ratchet located between two lugs. Similarly, the locating plug has another end provided with two lugs and a ratchet located between two lugs. The ratchets of the horizontal shaft and the locating plug serve to retain securely two resilient cords capable of carrying a plurality of massaging rollers.

The foregoing objective, features, functions and advantages of the present invention will be more readily understood upon a thoughtful deliberation of the following detailed description of the present invention in conjunction with the accompanying drawings.

BRIEF DESCRIPTION OF THE DRAWINGS

FIG. 3 shows an exploded view of the massaging roller assembly of the present invention.

FIG. 4 shows a sectional view of the massaging roller assembly of the present invention.

FIG. 5 shows a perspective view of the massaging roller assembly of the present invention.

DETAILED DESCRIPTION OF THE INVENTION

Figure 1:
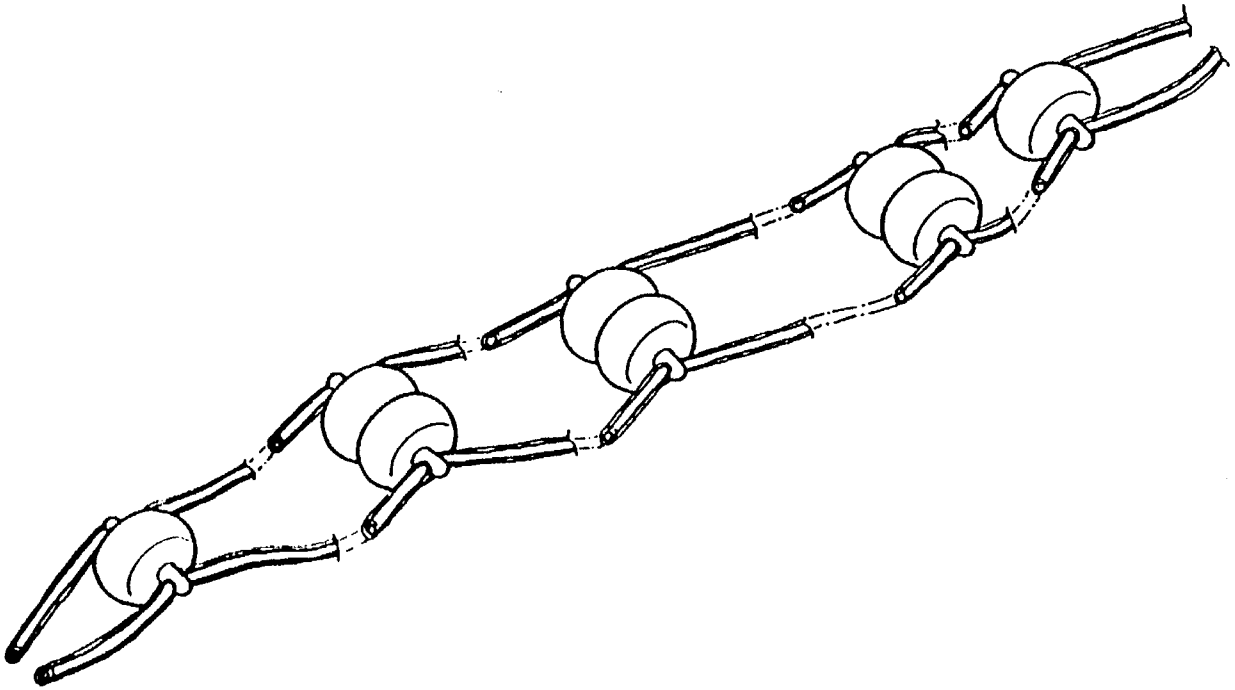
FIG. 1 PRIOR ART
FIG. 1 shows a perspective view of a massaging device of the prior art.
Figure 2:
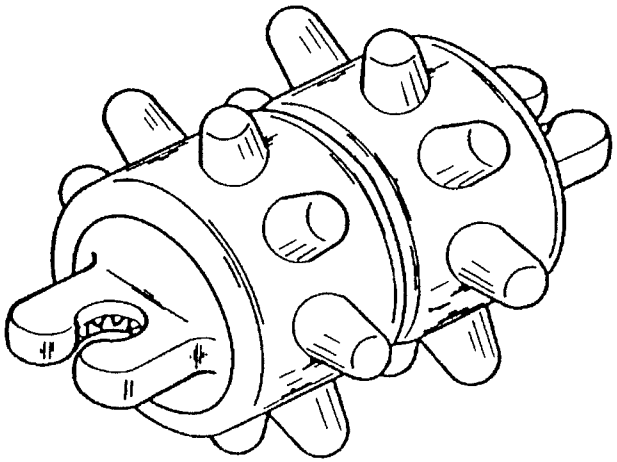
FIG. 2 shows a perspective view of a massaging roller assembly of the present invention.

As shown in FIGS. 2 and 3, a massaging roller assembly embodied in the present invention comprises a horizontal shaft 10, a plurality of roller sleeves 20 fitted rotatably over the shaft 10, and a locating plug 30 secured to one end of the shaft 10. The roller sleeves 20 are provided respectively on the outer wall surface thereof with a plurality of massaging protuberances 21. One end of the shaft 10 is of a hollow construction and is provided on the inner wall thereof with two retaining ribs 11 opposite in location to each other and engageable with two retaining slots 31 located in the outer wall of one end of the locating plug 30. In addition, the retaining ribs 11 are provided thereon respective with a projection 12 engageable with a recess 32 located in the retaining slot 31 of the locating plug 30. The shaft 10 is provided at another end thereof with two lugs 14 and a ratchet 13 located between two lugs 14. Similarly, the locating plug 30 is provided at another end thereof with two lugs 34 and a ratchet 33 located between two lugs 34.

In combination, the roller sleeves 20 are fitted over the shaft 10 from the hollow end of the shaft 10 before the locating plug 30 is secured to the hollow end of the shaft 10. The roller sleeves 20 are located securely by the locating plug 30 which is fastened with the hollow end of the shaft 10 such that the retaining slots 31 of the locating plug 30 are engaged securely with the retaining ribs 11 of the shaft 10, and that the recesses 32 of the retaining slots 31 of the locating plug 30 are engaged securely with the projections 12 of the retaining ribs 11 of the shaft 10.

As shown in FIGS. 4 and 5, a plurality of roller assemblies of the present invention are fastened at an interval with two resilient cords 40, which are retained respectively by the ratchet 13 of the shaft 10 and the ratchet 33 of the locating plug 30. The resilient cords 40 are forced in to be retained by the ratchets 13 and 33 via the openings located respectively between the free ends of the lugs 14 or 34.

The massaging roller assembly of the present invention has several inherent advantages, which are expounded explicitly hereinafter.

The component parts of each roller assembly of the present invention are made integrally and are therefore relatively cost-effective.

The roller assemblies of the present invention can be combined easily and rapidly with two resilient cords to form a handy massaging device. As a result, the production efficiency is greatly improved.

The damaged roller assembly of the present invention can be replaced easily and rapidly by detaching the damaged roller assembly from the two resilient cords to which it is fastened.

The massaging roller assembly of the present invention affords an excellent massaging effect in view of the fact that each of the roller sleeves of the roller assembly of the present invention is provided on the outer wall surface thereof with a plurality of massaging protuberances, and that each of the roller sleeves are fitted rotatably over the shaft so as to afford an excellent stimulation on the back of a human body.

A plurality of the massaging roller assemblies of the present invention can be combined to form a massaging device of a desired length to suit individual requirement of a user of the device.

The embodiment of the present invention described above is to be regarded in all respects as being merely illustrative and not restrictive. Accordingly, the present invention may be embodied in other specific forms without deviating from the spirit thereof. The present invention is therefore to be limited only by the scope of the following appended claims.

What is claimed is:

1. A roller assembly for a massaging device, said roller assembly comprises:

a shaft having one end of a hollow construction and further having another end provided with two lugs and a ratchet located between said two lugs for holding securely a resilient cord, said one end of a hollow construction provided in an inner wall thereof with a plurality of retaining ribs arranged at an interval;

a plurality of roller sleeves fitted rotatably over said shaft and provided respectively on an outer wall surface thereof with a plurality of massaging protuberances; and a locating plug having one end secured to said one end of said shaft, said one end of said locating plug provided in an outer wall surface thereof with a plurality of retaining slots engageable with said retaining ribs of said shaft when said locating plug is secured to said one end of said shaft, said locating plug further having another end provided with two lugs and a ratchet located between said two lugs for holding securely a resilient cord.

2. The roller assembly as defined in claim 1, wherein said retaining ribs of said shaft are provided respectively with a projection; and wherein said retaining slots of said locating plug are provided respectively with a recess engageable securely with said projection.

* * * * *